US007241226B2

(12) United States Patent
Costain et al.

(10) Patent No.: US 7,241,226 B2
(45) Date of Patent: Jul. 10, 2007

(54) UNIVERSAL FITTING FOR A CUE STICK

(76) Inventors: Paul D. Costain, 2 Spuce Run, Beverly, MA (US) 01915; Bill Stroud, 8 Circle Dr., Ruidoso Downs, NM (US) 88346

( * ) Notice: Subject to any disclaimer, the term of this patent is extended or adjusted under 35 U.S.C. 154(b) by 0 days.

(21) Appl. No.: 10/972,087

(22) Filed: Oct. 22, 2004

(65) Prior Publication Data

US 2006/0089204 A1 Apr. 27, 2006

(51) Int. Cl.
*A63D 15/08* (2006.01)

(52) U.S. Cl. ..... 473/44; 473/46

(58) Field of Classification Search ..... 473/44–49, 473/288; 411/397; 403/299, 303
See application file for complete search history.

(56) References Cited

U.S. PATENT DOCUMENTS

| | | | | |
|---|---|---|---|---|
| 248,681 | A | 10/1881 | Walter | |
| 682,677 | A | 9/1901 | Ferchland | |
| 965,131 | A | 7/1910 | Bliss | |
| 970,172 | A | 9/1910 | Bloom et al. | |
| 3,232,613 | A | 2/1966 | Laube, Jr. | |
| 3,436,079 | A | 4/1969 | Berry et al. | |
| 3,462,147 | A * | 8/1969 | Mancuso | 473/44 |
| 4,231,574 | A | 11/1980 | Williams | |
| 4,340,227 | A | 7/1982 | Dopkowski | |
| 4,565,392 | A | 1/1986 | Vyse | |
| 4,630,958 | A | 12/1986 | McCallister | |
| 4,645,245 | A | 2/1987 | Cunningham | |
| 4,816,203 | A | 3/1989 | Son-Kung | |
| 5,062,636 | A | 11/1991 | Rahn | |
| 5,112,046 | A | 5/1992 | Thorpe | |
| 5,334,101 | A | 8/1994 | McDermott | |
| 5,514,039 | A | 5/1996 | Gendron et al. | |
| 5,518,455 | A | 5/1996 | Costain et al. | |

(Continued)

FOREIGN PATENT DOCUMENTS

| | | |
|---|---|---|
| CA | 726.578 | 1/1966 |

(Continued)

OTHER PUBLICATIONS

Drawing of coupling rod manufactured by Bender Cues for securing to one stick portion of a cue stick (Jul. 13, 1992).

(Continued)

*Primary Examiner*—Mark S. Graham
(74) *Attorney, Agent, or Firm*—Hamilton, Brook, Smith & Reynolds, P.C.

(57) ABSTRACT

In an embodiment of the invention, a universal shaft fitting for a cue stick comprises a universal adapter with an extension having external threads, adapted to be bonded into the butt end of a shaft of a cue stick, and an insert adapted to be bonded to internal threads of the universal adapter. The insert also includes internal threads for detachably mating a pin attached to another segment of a cue stick. Other embodiments include universal shaft fittings with various pin configurations and universal shaft fittings that do not utilize an insert. The universal shaft fittings may be utilized as components of a kit for adapting shafts to receive segments of cue sticks with various pin configurations. The universal shaft fittings may also be utilized in a method of supplying shafts to fit segments of cue sticks.

14 Claims, 8 Drawing Sheets

U.S. PATENT DOCUMENTS

| | | | | |
|---|---|---|---|---|
| 5,527,224 | A | | 6/1996 | Costain et al. |
| 5,749,788 | A | * | 5/1998 | Bourque ..... 473/44 |
| 5,827,797 | A | | 10/1998 | Cass et al. |
| 5,869,189 | A | | 2/1999 | Hagood, IV et al. |
| 5,890,966 | A | | 4/1999 | Costain et al. |
| 5,927,894 | A | | 7/1999 | Zavaglia |
| 6,027,410 | A | | 2/2000 | Costain et al. |
| 6,048,622 | A | | 4/2000 | Hagood, IV et al. |
| 6,110,051 | A | | 8/2000 | McCarty et al. |
| 6,132,321 | A | | 10/2000 | Wethered |
| 6,227,980 | B1 | | 5/2001 | Costain et al. |
| 6,348,006 | B2 | | 2/2002 | Costain et al. |
| 6,395,080 | B1 | | 5/2002 | Cass et al. |
| 6,398,660 | B1 | | 6/2002 | Probst et al. |
| 6,620,287 | B2 | | 9/2003 | Cass |
| 6,712,712 | B2 | | 3/2004 | Bourque |
| 6,736,733 | B2 | | 5/2004 | Yu |
| 2004/0009822 | A1 | | 1/2004 | McCarty |

FOREIGN PATENT DOCUMENTS

| | | | |
|---|---|---|---|
| GB | 8849 | A | 7/1885 |
| GB | 2191707 | A | 12/1987 |
| GB | 2192800 | A | 1/1988 |
| GB | 2199505 | A | 7/1988 |
| GB | 2219946 | A | 12/1989 |
| GB | 2226251 | A | 6/1990 |
| GB | 2246302 | A | 1/1992 |

OTHER PUBLICATIONS

Drawing of a prior art cue stick portion having a coupling rod and joint collar (at least by 1985).

* cited by examiner

UNIVERSAL FITTING FOR A CUE STICK

BACKGROUND OF THE INVENTION

Cue sticks are often separable into a shaft and butt for portability and storage convenience. The shaft portion includes the end of the cue stick used to strike a cue ball. The butt portion includes the handle of the cue stick. Typically a shaft is configured to mate with only one particular butt through a joint system. The butt includes an end with a pin having a particular thread configuration. The corresponding shaft is manufactured with a particular insert having an internally threaded section for detachably mating with the specific pin configuration used by the butt. Cue sticks may also be separable into shaft, intermediate, and butt end segments that are similarly mated.

SUMMARY OF THE INVENTION

Shafts are susceptible to damage owing to their relative thinness compared to a butt. Thus, a particular handle may still form a useful cue stick with a replacement shaft. As well, different shafts and handles may have particular mechanical or aesthetic properties that a player may wish to utilize in a particular combination. Shafts, for example, may have varying lengths, weights, or mechanical properties. Handles may have particular decorative features that a player desires. Thus, the interchangeability of a handle with different shafts would allow a player to tailor a handle and shaft as desired.

Manufacturers of cue stick shafts must currently create shafts with a particular insert, having an internally threaded region, embedded into the end of the shaft to mate a particular pin configuration of a handle. Therefore, substantial resources and effort must be devoted by manufacturers to creating and maintaining an inventory of shafts with appropriate inserts to fit various types of cue stick handles.

In certain embodiments of the invention, shafts of cue sticks that fit other segments of cue sticks are supplied with a common butt end configuration adapted to be bonded to a universal shaft fitting. Universal shaft fittings have various configurations of internal threads for receiving various pin configurations associated with the segments of cue sticks. Each universal shaft fitting has a common shaft end configuration adapted to be bonded to any of the shafts. The shafts are fitted to a segment of a cue stick by selecting a shaft and selecting a universal shaft fitting that has a thread configuration that mates the pin configuration of the segment, the universal shaft fitting being bonded to the shaft. Thus, a common inventory of shafts may be provided for all pin configurations. An inventory of different universal shaft fitting then adapts any shaft to any other segment.

Each universal shaft fitting may comprise a universal adapter and an insert. The universal adapter has the common shaft end configuration adapted to bond to any of the shafts. The insert is adapted to bond to the universal adapter, and has an internally threaded region that may receive a particular pin configuration of one of the segments. In supplying the shafts, a receiver may be bonded to one or more of the shafts, the receiver having the common butt end configuration.

A universal shaft fitting kit for adapting a set of shafts to fit with a set of segments that have various pin configurations is described. The kit includes a set of universal shaft fittings that have various configurations of internal threads for receiving various pin configurations associated with segments of cue sticks. Each universal shaft fitting has a common shaft end externally threaded configuration adapted to be bonded to any of the shafts.

Each universal shaft fitting may comprise a universal adapter and an insert. The universal adapter may include polyethylene terephthalate. The insert may include brass. The kit may also include a set of receivers, each receiver being adapted to bond to the butt end of a shaft. Each receiver also has a common internally threaded configuration to mate and bond with the common externally threaded shaft end configuration of each universal shaft fitting. The universal shaft fittings may have a substantially circular cross section surface with a diameter between about 0.82 inches and about 0.86 inches. In particular the circular cross section diameter may be about 0.835 inches, about 0.841 inches, about 0.845 inches, or about 0.850 inches. The internal threads of one or more of the universal shaft fittings may be configured as ball screw threads, ⅜-10 threads, 5/16-14 threads, 5/16-18 threads, or to detachably mate a pin of a segment within about one revolution.

A kit of parts for creating a set of adapted shafts that receive segments of cue sticks having various pin configurations is presented. The kit includes a set of shafts having a common butt end and a set of universal shaft fittings as described above. The universal shaft fittings may each include a universal adapter and an insert. The kit may also include a set of receivers, each adapted to be bonded to the common butt end of any shaft and having a common internally threaded configuration to mate and bond with the common externally threaded shaft end of each universal shaft fitting.

As noted above, a universal shaft fitting may comprise a universal adapter and an insert. The universal adapter may include internal threads and an extension with external threads that are adapted to bond into a butt end of a shaft of a cue stick. The insert may include an extension with external threads adapted to bond with the internal threads of the universal adapter. The insert may also include internal threads to detachably receive an externally threaded pin of a segment of a cue stick.

A related embodiment of the invention is an adapted shaft for receiving a segment of a cue stick that includes a shaft, a universal adapter, and an insert. The universal adapter has an extension with external threads that are bonded to attach the universal adapter to the butt end of the shaft. The insert has an extension with external threads that are bonded to internal threads of the universal adapter. The insert also has internal threads to detachably receive an externally thread pin attached to the segment of the cue stick. The adapted shaft may also include a receiver that is bonded to the butt end of the shaft, the receiver having an internally threaded configuration mating and bonding with the external threads of the universal adapter.

A vibration reducing shaft for a cue stick is presented in another embodiment of the invention. The vibration reducing shaft includes a shaft and a universal shaft fitting. The shaft includes damping material configured to reduce the vibration of the shaft when a ball strikes a free end of the shaft. The vibration reducing shaft may be configured to form an axially rigid ensemble with the segment of the cue stick when the externally threaded pin is received by the shaft.

A universal insert for connecting two segments of a cue stick is also described. The first segment has a common end configuration. The universal insert has a common complementary end configuration adapted to receive and bond the universal insert to the common end configuration of the first segment. The universal insert also has a complementary threaded configuration adapted to detachably receive a threaded configuration of the second segment. The universal insert may comprise a universal adapter having the common complementary end configuration and an insert having the complementary threaded configuration. The universal insert may be utilized in a kit, as part of an adapted segment of a cue stick, or in a method to join sets of segments of cue sticks.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF THE INVENTION

A description of preferred embodiments of the invention follows.

Figure 1A:
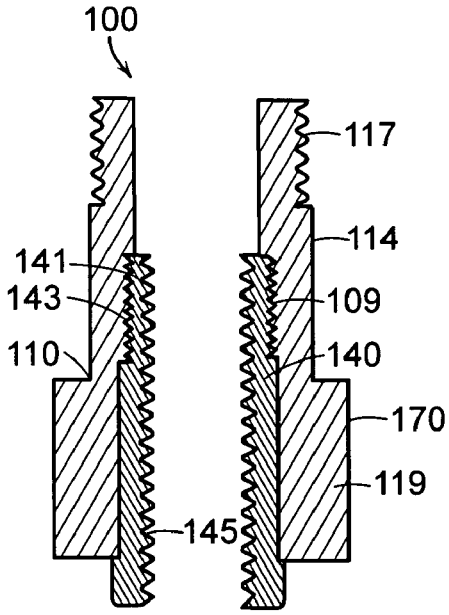
FIG. 1A is a cross sectional side view of a universal adapter and insert in accordance with an embodiment of the invention.
Figure 1B:
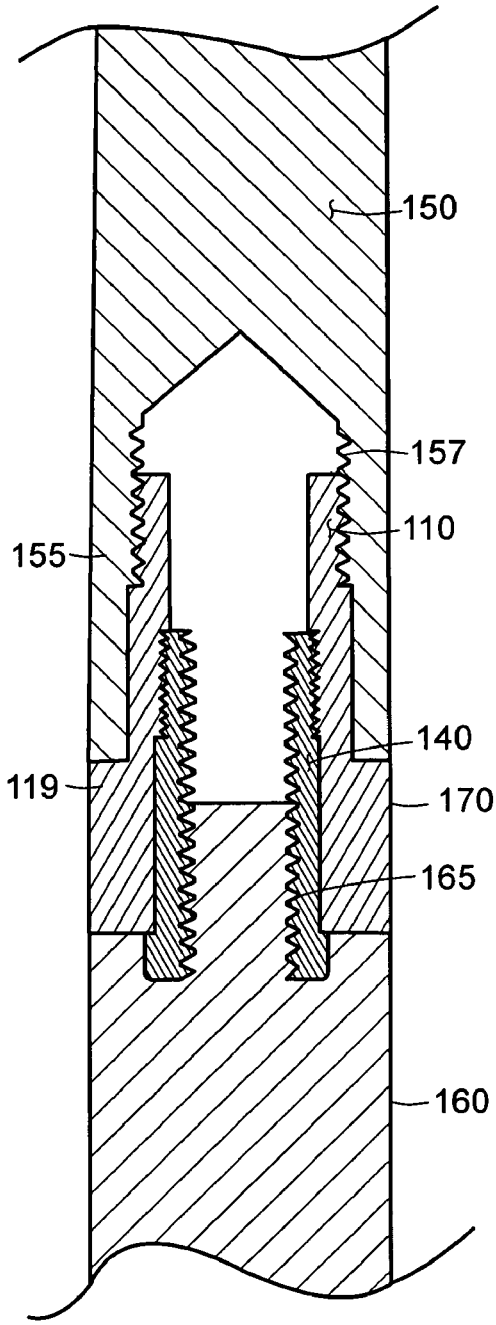
FIG. 1B is a cross sectional side view of the universal adapter and insert of FIG. 1A incorporated into a cue stick shaft, in accordance with an embodiment of the invention, with a pin of a joining segment of the cue stick detachably mating the insert.

A first embodiment of the invention directed toward a universal shaft fitting for adapting a shaft to receive a segment of a cue stick is depicted in FIG. 1A. A universal shaft fitting 100 is comprised of a universal adapter 110 and an insert 140. The universal adapter 110 has an extension 114 with external threads 117. The external threads 117 are adapted to be bonded into the butt end 155 of a cue shaft 150 as shown in FIG. 1B. The universal adapter 110 also has internal threads 109. The insert 140 has an extension 141 with external threads 143 that are adapted to be bonded to the internal threads 109 of the universal adapter 110. The insert 140 also has internal threads 145 that can detachably receive an externally threaded pin 165 which is attached to a segment 160 of a cue stick.

The universal shaft fitting adapts a shaft to receive a particular pin configuration of a segment of a cue stick through the selection of the appropriate insert to be inserted into the universal adapter. Thus, manufacturers may produce shafts with uniform butt ends that are configured to receive a universal adapter, without the need to custom tailor the shaft to receive a particular pin configuration.

In many instances, cue sticks are composed of two detachable pieces, a shaft with a free end to strike a cue ball, and a butt end with a handle. Thus, embodiments of the invention tailored to receive the pin of a segment could specifically receive the pin of a butt end of a cue stick. Cue sticks, however, may be made of three or more pieces. Thus, embodiments of the invention may also allow a shaft to detachably receive a segment of a cue stick that does not include the handle. Though the embodiments of the invention described herein describe the joining of cue stick shafts with other segments of a cue stick, it is readily understood that embodiments of the invention may also be used to attach two segments of a cue stick that do not include a shaft.

The universal adapter may include a material that tends to retain a particular configuration without substantial shrinkage or expansion due to aging or exposure to changes in environmental conditions (e.g., humidity). For example, materials such as polyethylene terephthalate may be particularly suitable.

The universal adapter 110, shown in FIG. 1A for example, may also have a section 119 with a substantially circular cross section surface 170. The substantially circular cross section surface 170 forms a surface of a cue stick between the shaft 150 and the other segment 160 of the cue stick when the shaft 150 and segment 160 are attached. Ideally, the surface from the shaft to the circular cross section surface to the other segment of the cue stick is smooth and continuous, though this is not necessary. When the segment of the cue stick is a butt end, the circular cross sections of the universal adapters may be made with a particular diameter to mate with conventional butt ends of cue sticks. For example, the diameter may be between about 0.82 inches and about 0.86 inches. In particular, the diameter may be a standard diameter, such as about 0.835 inches, about 0.841 inches, about 0.845 inches, or about 0.850 inches.

Inserts may be made of a material that is particularly suited for detachably mating with a pin such that a cue stick may be assembled and disassembled frequently without the pin or insert substantially wearing over the life usage of the cue stick. For example, an insert may utilize brass.

Figure 2A:
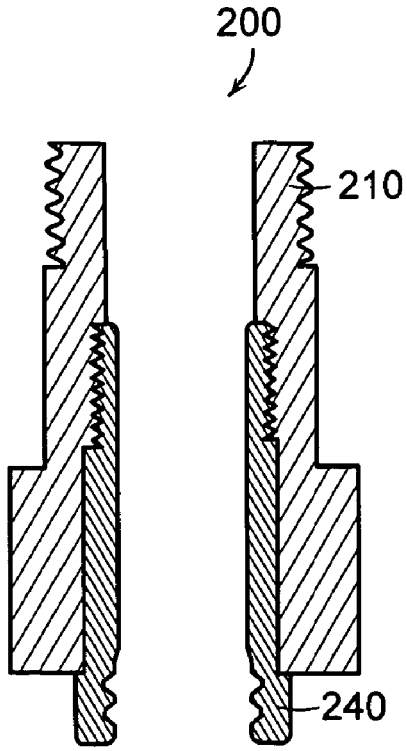
FIG. 2A is a cross sectional side view of a universal adapter and insert in accordance with an embodiment of the invention, the insert configured to detachably mate a pin within about one revolution.
Figure 2B:
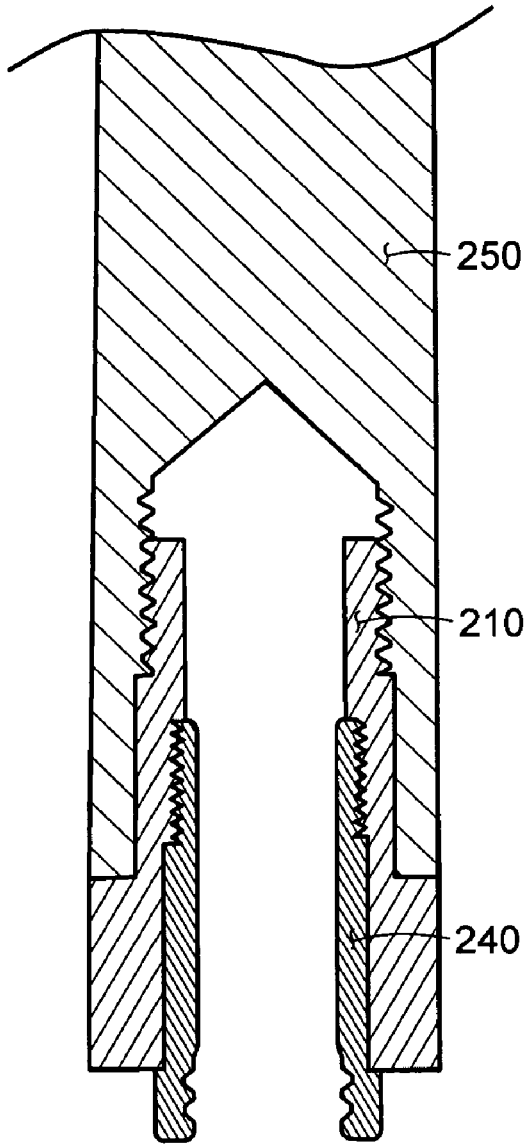
FIG. 2B is a cross sectional side view of the universal adapter and insert of FIG. 2A incorporated into a cue stick shaft, in accordance with an embodiment of the invention.

Various configurations of inserts may be utilized with embodiments of the invention, the insert chosen to detachably mate a particular type of pin configuration used with a segment of the cue stick. In FIGS. 1A and 1B, the internal threads 145 of the insert 140 are configured to receive a pin 165 having 5/16-18 threads. As shown in FIGS. 2A and 2B, an insert 240 of a universal shaft fitting 200 may be inserted into a universal adapter 210 and configured to firmly and detachably mate an externally threaded pin of a cue stick segment with a shaft 250 within about one revolution (such pins and inserts are available as the Uni-Loc® joint system from the Uni-Loc Corporation of America, Rowley, Mass.). Other examples of types of inserts that may be used include inserts having internal threads configured to mate with pins having 3/8-10 threads, 5/16-18 threads, and ball screw threads 412 (e.g., the Radial® pin available from the Uni-Loc Corporation of America, Rowley, Mass.); the latter shown in FIGS. 4A and 4B. Other types of inserts, as known to those skilled in the art, may also be utilized.

The insert may be bonded with the internal threads of the universal adapter in any manner known to those skilled in the art. Adhesives or epoxy may be employed to create a bond. Adapting the insert and/or the universal adapter to create such a bond may include utilizing a notch or a gap to hold adhesive or epoxy. Alternatively, the surfaces of external threads of the insert and internal threads of the universal adapter may have a character such that contact may result in bonding of a permanent or semi-permanent character. All of these, among others, are contemplated within the scope of the invention.

Figure 3A:
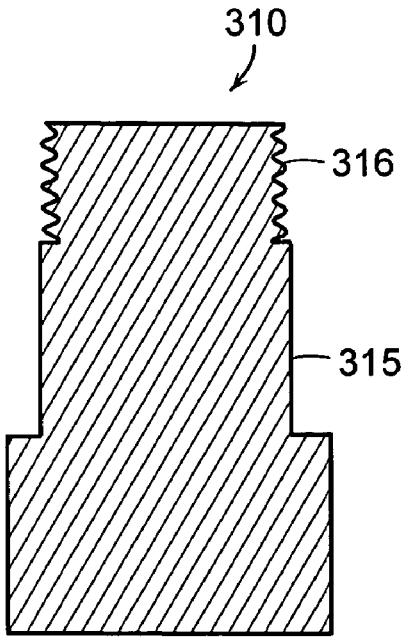
FIG. 3A is a cross sectional side view of a universal adapter, in accordance with an embodiment of the invention.
Figure 3B:
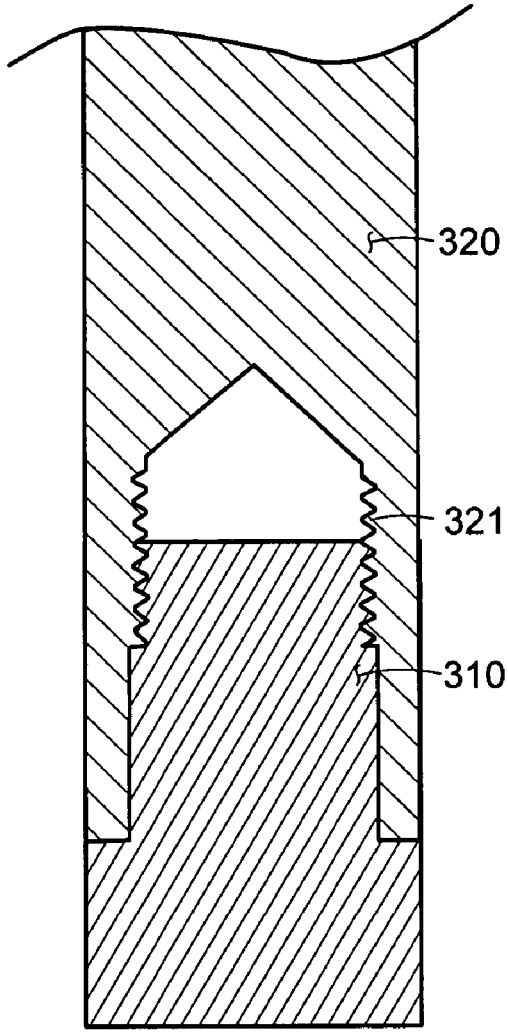
FIG. 3B is a cross sectional side view of the universal adapter of FIG. 3A incorporated into a cue stick shaft, in accordance with an embodiment of the invention.

In another embodiment of the invention, a universal shaft fitting has a form without an insert. With reference to FIGS. 3A and 3B, the universal adapter 310 has a common shaft end configuration 315, which is adapted to be bonded to a shaft 320 as shown in FIG. 3B. The universal adapter may be formed into a universal shaft fitting by including an internally threaded section in the universal adapter with a particular thread configuration to receive a pin with the corresponding external thread configuration. For example, as shown in FIGS. 4A and 4B, the particular universal shaft fitting 410 includes an inner section of ball screw internal threads 412 to mate with the pin 465 of another segment 460 of the cue stick having external ball screw threads. The internal threaded section may be formed by drilling into the universal adapter, and forming the walls of the orifice with a particular thread configuration. Thus, the use of an inset may be obviated.

Figure 4C:
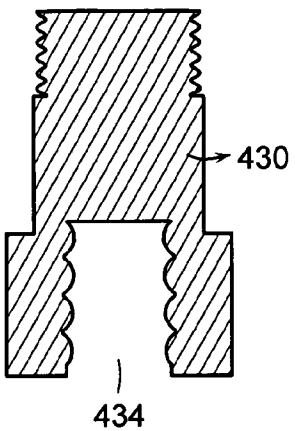
FIG. 4C is a cross sectional view of a universal shaft fitting with an orifice tunneling partially into the universal shaft fitting, in accordance with an embodiment of the invention, the sides of the orifice having ball screw threads.
Figure 4B:
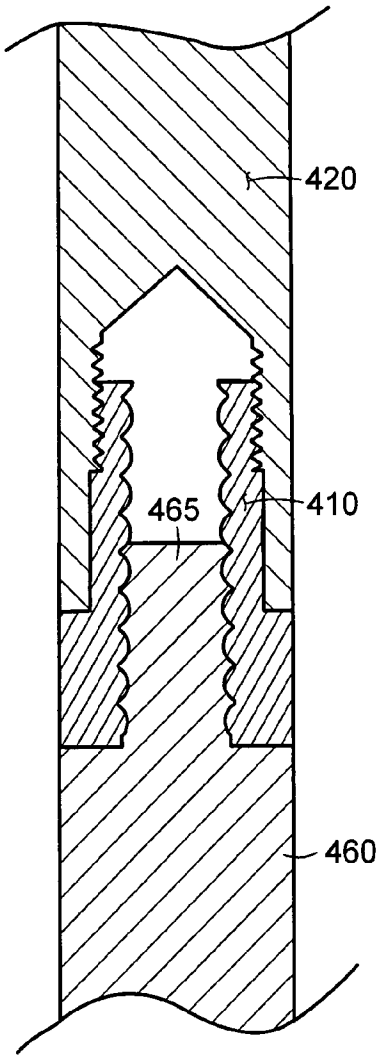
FIG. 4B is a cross sectional side view of the universal shaft fitting of FIG. 4A incorporated into a cue stick shaft, in accordance with an embodiment of the invention, with a pin of a joining segment of the cue stick detachably mating with the internal threaded section of the universal shaft fitting.
Figure 4A:
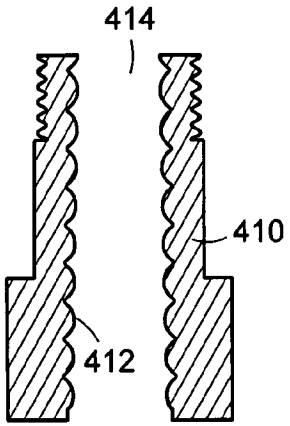
FIG. 4A is a cross sectional side view of a universal shaft fitting with an orifice tunneling through the universal shaft fitting, in accordance with an embodiment of the invention, the sides of the orifice having ball screw threads.

Though the universal shaft fitting 412 of FIG. 4A is shown with an orifice 414 that completely penetrates the adapter body, a universal shaft fitting 430 may also be formed with an orifice 434 that does not tunnel completely through the adapter body, as depicted in FIG. 4C. Similarly, universal shaft fittings that utilize an insert may be configured such that the insert forms a liner that covers a penetrating orifice (e.g., as shown in FIGS. 1A and 2A), either partially or completely, or the insert may be embedded in the adapter without penetrating completely through the adapter as shown by the universal shaft fitting 626 in FIG. 6.

The common shaft end configuration of a universal shaft fitting is such that the universal shaft fitting may mate and bond with a shaft. For example, as shown in FIGS. 3A and 3B, the universal shaft fitting 310 has an extension 315 with external threads 316, which mate with the internal threads 321 of the shaft 320. However, other common shaft end configurations are possible. In another example, the extension of a universal shaft fitting may not be threaded; a cylindrical extension may fit within a cylindrical bore in the shaft. Other tapered shapes, as well as other configurations, are all potential common shaft end configurations. The common shaft end configurations may also be utilized with a universal adapter in particular embodiments of the invention described herein.

Figure 5C:
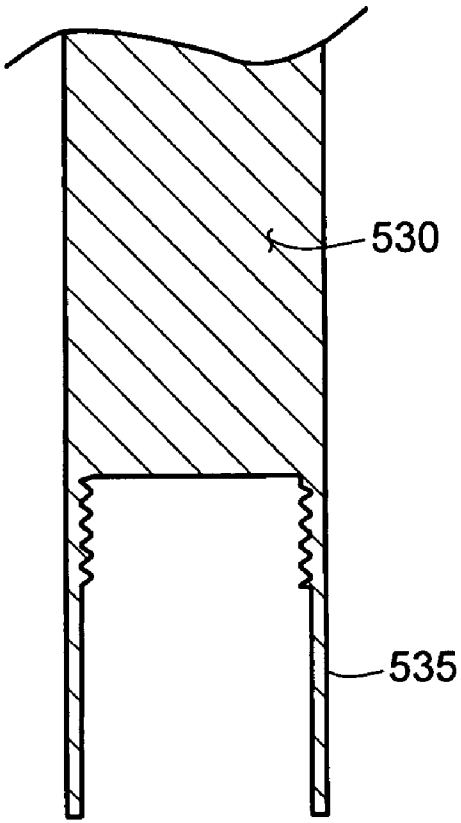
FIG. 5C is a cross sectional side view of a portion of the shaft of a cue stick in accordance with an embodiment of the invention.
Figure 5B:
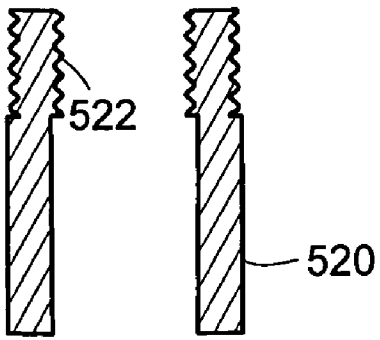
FIG. 5B is a cross sectional side view of a receiver in accordance with an embodiment of the invention.
Figure 5A:
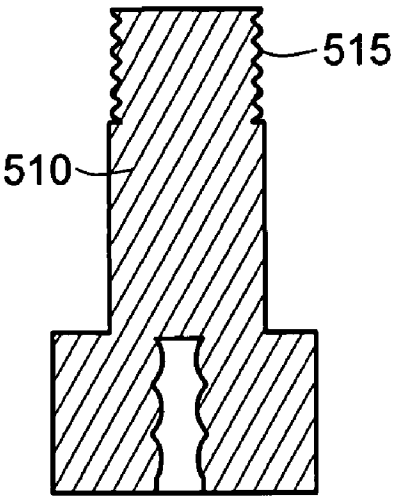
FIG. 5A is a cross sectional side view of a universal shaft fitting, in accordance with an embodiment of the invention.

Embodiments of the invention may utilize a receiver to help bond the universal shaft fitting to the shaft of a cue stick. As depicted in FIGS. 5A-5C, a receiver 520 is adapted to be bonded to the butt end 535 of a shaft 530. The receiver 520 has an internally threaded configuration 522 to mate and bond with the external threads 515 of a universal shaft fitting 510. In the particular embodiment shown in FIG. 5B, the receiver includes an extension with external threads to bond with an internally threaded section of the butt end of the shaft (e.g., M28-2 threading). However, such threading in the receiver and shaft are not required as any configuration that allows bonding between the two is allowable (e.g., a smooth cylindrical shape may be used to fit with an opening of the shaft). Furthermore, receivers include any type of common configuration to allow mating and bonding with the common shaft end of a universal adapter (e.g., the receiver may have an smooth cylindrical bore to receive a smooth cylindrical extension of a universal adapter, the complementary pieces not utilizing a threaded configuration). Bonding may be by any method known to those skilled in the art, as discussed earlier.

Such an embodiment may be particularly useful when a shaft is made of wood, or some other material subject to changes in form when exposed to variations in environmental conditions (e.g., moisture level). The receiver preferably includes a material which is resilient to such changes in form, to insure a good fit between the receiver and the universal shaft fitting.

Universal shaft fittings that may be utilized with a receiver include any of the aforementioned universal shaft fittings, including the entire range of modifications discussed herein (e.g., universal shaft fittings with and without an insert).

Using any of the universal shaft fittings discussed herein, a related embodiment of the invention is directed to an adapted shaft for receiving a segment of a cue stick. The adapted shaft includes a universal shaft fitting with bonded external threads to attach the universal shaft fitting to a shaft. Specific examples of such an embodiment are depicted in FIGS. 1B, 2B, and 4B. Such an adapted shaft may also use a universal shaft fitting having any of the variations described herein. The adapted shaft may also include the use of a receiver, as described earlier, bonded to the butt end of a shaft to mate and bond the universal shaft fitting.

Though some embodiments of the invention that utilize a universal shaft fitting configure the fitting to bond to the shaft of a cue stick, a universal shaft fitting may not necessarily be permanently bonded to the cue stick. In such an instance, various universal shaft fittings, each having different internally threaded regions for receiving various pin configurations, may be interchangeably used with a shaft having a common butt end, allowing the same shaft to be detachably connected with segments of cue sticks having different pin configurations.

Figure 6:
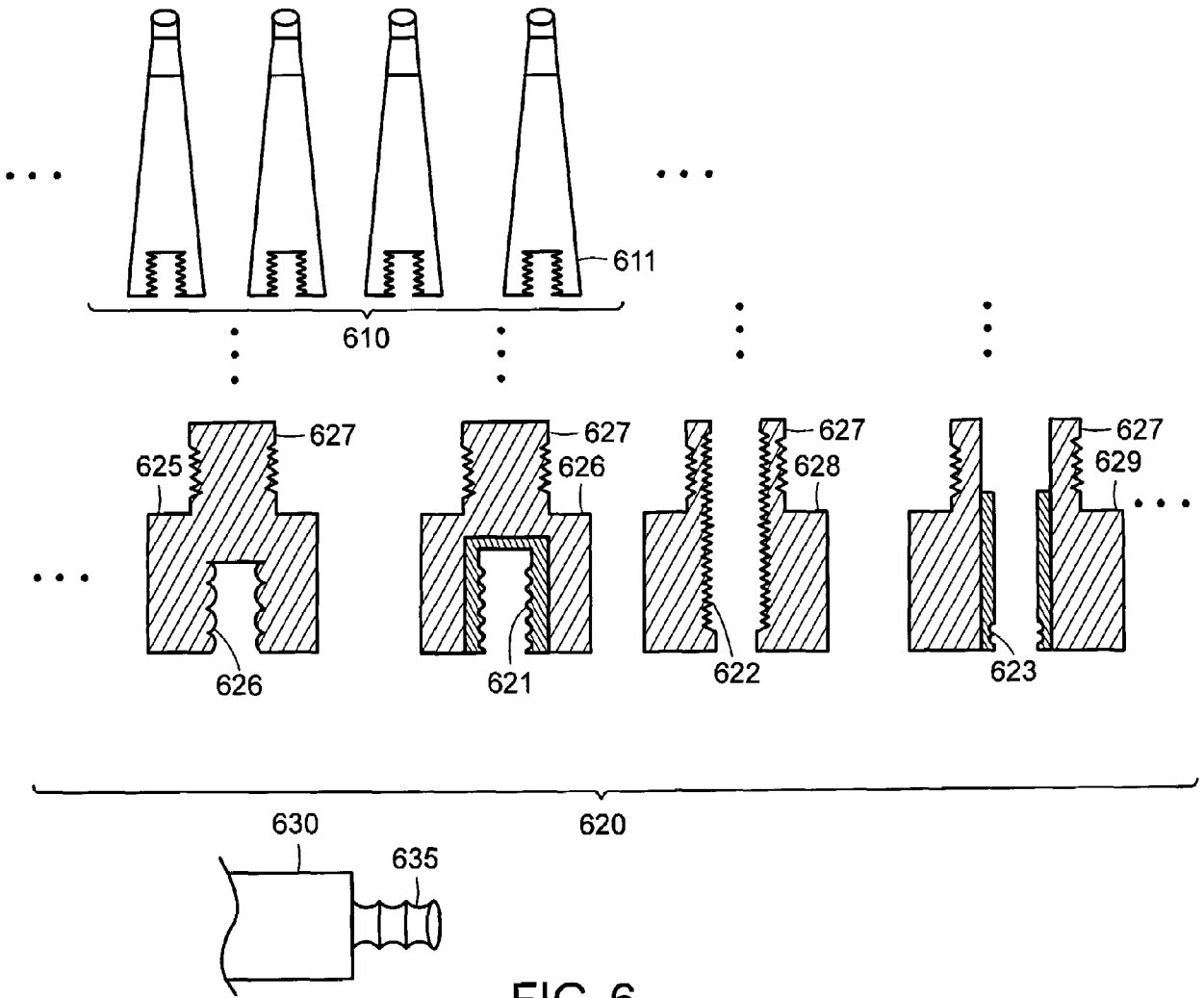
FIG. 6 is a schematic diagram, not to scale, of set of cue sticks, a kit including a set of universal shaft fittings, and a cue stick segment with a ball screw threaded pin, in accordance with an embodiment of the invention.

The various universal shaft fittings described herein may be utilized to form a kit for adapting cue stick shafts to receive cue stick segments, each segment having a pin with a particular pin configuration (e.g., threading). A schematic, not drawn to scale, consistent with an embodiment of the invention that utilizes such a kit is shown in FIG. 6. Each member of a set of shafts 610 have butt end 611. The kit comprises a set of universal shaft fittings 620 having internally threaded sections. FIG. 6 explicitly depicts subsets 625, 626, 628, and 629, each of plural universal shaft fittings of the set 620, each subset being adapted to a particular pin configuration. Other members of the set 620 may include universal shaft fittings with different configurations (e.g., having different internal threaded sections). Each internally threaded section of a universal shaft fitting has a particular thread configuration, for example the configurations 621, 622, 623, 626 for the depicted universal shaft fittings in FIG. 6, that can detachably receive a particular pin configuration utilized with a segment to form a cue stick, or a portion of a cue stick. Each universal shaft fitting also has a common shaft end externally threaded configuration 627 that is adapted to be bonded to the butt end 611 of any one of the shafts 610.

The kit may be utilized such that a shaft may be adapted to receive a segment of a cue stick having a particular pin configuration. For example, as shown in FIG. 6, a particular segment 630 shown uses a ball screw thread configuration with its pin 635. Thus, the appropriate universal shaft fitting 625, having internal ball screw threads 626, may be chosen to mate with the butt end 611 of a shaft so that the shaft may detachably receive the segment 630 to form a cue stick, or a portion thereof.

A kit, such as described by the previous embodiment, may be used to ease the production of cue sticks. Manufacturers of cue stick shafts may produce a common butt end configuration for each shaft. Utilizing the kit, the shafts may be customized to fit a particular pin configuration associated with a cue stick butt to form a cue stick. Thus, shaft manufacturers need not produce and inventory sets of shafts for each particular pin configuration. Furthermore, butt ends of cue sticks may be readily matched with different shafts to produce cue sticks with various properties suited to a pool player.

The kit may utilize any of the variations described with respect to universal shaft fittings described herein. For example, in the kit 620 depicted in FIG. 6, two of the universal shaft fittings 621, 623 utilize inserts in a universal adapter, while the other two universal shaft fittings 625, 628 have an internal threaded segment end that is directly formed into the universal shaft fitting. As well, two of the universal shaft fittings 628, 629 have an orifice that completely penetrates the insert, while the other two 625, 626 do not tunnel through the universal shaft fitting. Each of the universal shaft fittings 620 also utilizes a different type of threading to mate with different types of pins. A kit may also include a set of receivers that are each adapted to bond to the butt end of any of the shafts. Each receiver includes a common configuration (e.g., internal threads) to mate and bond with the common shaft end configuration of the universal shaft fittings.

In a related embodiment of the invention, a set of adapted shafts may be assembled from the component parts of a kit. Unlike the previous embodiment of the invention which comprised a set of universal shaft fittings, the related embodiment also includes a set of shafts. Each of the shafts has a common butt end configuration for accepting any of the universal shaft fittings. Thus, assembling the components of the kit provides a set of adapted shafts configured to detachably receive various pin configurations associated with other sections of a cue stick. Universal shaft fittings utilized with this embodiment of the invention may include any of the features of universal shaft fittings discussed herein, including the use of universal adapters, inserts, and receivers.

Various universal shaft fittings, as described by embodiments of the invention herein, may be utilized with the method. For example, the method may be practiced using a universal shaft fitting that includes a universal adapter and insert, or a universal shaft fitting that does not utilize an insert. As well, a receiver may be bonded to one or a more of the shafts; the receiver having the common configuration utilized for fitting and bonding with a universal shaft fitting.

In another embodiment of the invention, a universal shaft fitting is utilized in conjunction with a vibration reducing shaft having a damping material to allow the shaft to fit with a cue stick segment having a particular pin configuration. A description of the aspects of a vibration reducing shaft are found in a U.S. patent application entitled "VIBRATION DAMPING FOR A CUE STICK," bearing Ser. No. 10/971,564 and having the same inventors and the same filing date as the present application. The entire teachings of the U.S. patent application are hereby incorporated herein by reference in their entirety.

Figure 7:
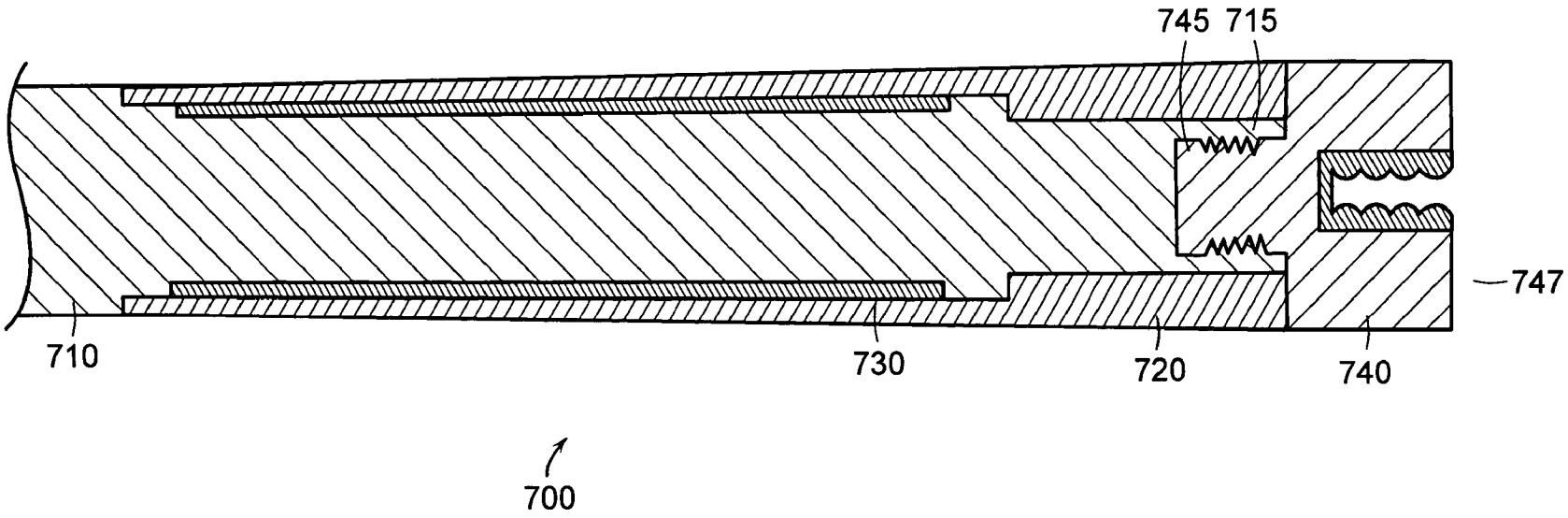
FIG. 7 is a cross sectional side view of a portion of a vibration reducing shaft that incorporates a universal shaft fitting, the universal shaft fitting including a universal adapter and an insert, in accordance with an embodiment of the invention.

FIG. 7 depicts a cross sectional view of a vibration reducing shaft consistent with an embodiment of the invention that incorporates the use of a universal shaft fitting. The vibration reducing shaft 700 includes a shaft 710 with a damping material 730 configured to reduce the vibration of the shaft when a ball strikes the end of the shaft. In the particular embodiment shown in FIG. 7, the damping material 730 is wrapped around the shaft 710 to form an annular region. A sleeve 720 is positioned over the shaft 710 and damping material 730. The vibration reducing shaft also includes a universal shaft fitting comprising a universal adapter 740 and an insert 747. The universal adapter has an extension 745 with external threads bonded into a butt end 715 of the shaft 710. The universal adapter 740 is also mated and bonded to the insert 747. The insert 747 has internal threads configured to detachably receive an externally threaded pin of a segment of a cue stick. The combination of the vibration reducing shaft and segment may form an axially rigid body.

Using a universal shaft fitting, as described by various embodiments of the invention herein, with a vibration reducing shaft further exemplifies the potential advantages of such devices. Manufacturers of vibration reducing shafts, and other types of shafts, may adapt shafts for use with existing cue stick butts without producing shafts that may only receive a particular type of pin configuration. Advantageously, the shafts may be produced with a common butt end configured to receive a universal shaft fitting. The shafts may be delivered to an end user or dealer who can choose the particular universal shaft fitting to suit the particular pin configuration of the desired cue stick butt or segment.

Other related embodiments of the invention combine various features of embodiments of a vibration reducing shaft, or cue stick, with features of a universal shaft fitting as revealed and incorporated herein. These are all within the scope of the present invention.

In another embodiment of the invention, analogous to the universal shaft fitting, a universal fitting is presented for detachably connecting two segments of a cue stick without regard to whether the segments include a shaft, handle section, or any other segment of a cue stick. With reference to FIG. 8A, two cue stick segments 810, 820 may be detachably connected using an appropriate universal fitting 830. The first segment 810 of the cue stick has a common end configuration 815. A universal fitting 830 has a common complementary end configuration 835 adapted to receive the first segment 810 through mating with the common end configuration 815. The universal fitting 830 also has a complementary threaded configuration 837 to detachably receive a specific threaded configuration 825 of the second segment 820. In FIG. 8A, the threaded configuration 825 is a pin with ball screw threads, while the complementary threaded configuration 837 of the universal insert 830 is the internal ball screw threaded section of the universal insert 830. Another universal insert 840 is depicted with the same common complementary end configuration 835, but a different complementary threaded configuration 845.

Figure 8B:
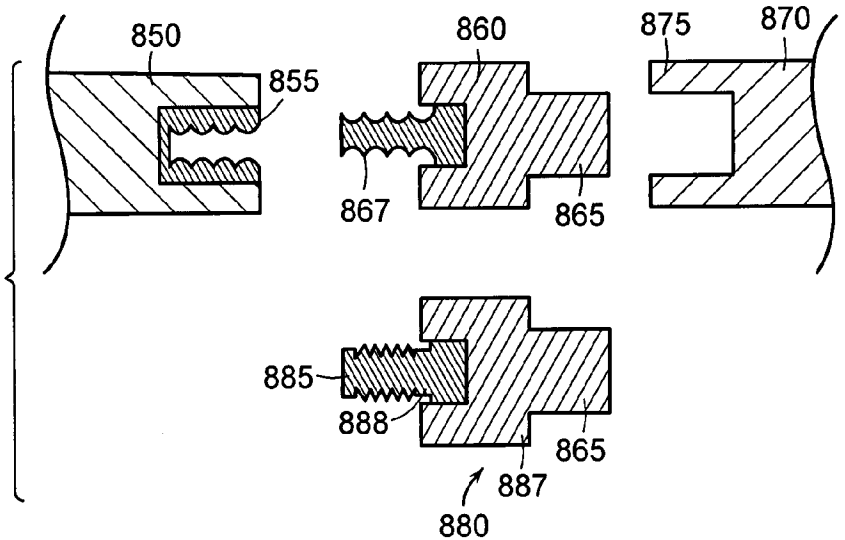
FIG. 8B is a cross sectional side view of universal inserts utilizing a different common complementary end configuration relative to the universal inserts shown in FIG. 8A, one of the universal inserts which may be used to join two segments of a cue stick in accordance with an embodiment of the invention.
Figure 8A:
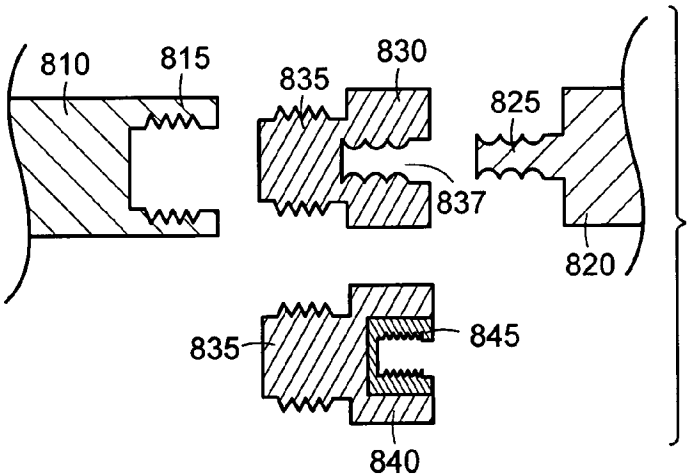
FIG. 8A is a cross sectional side view of universal inserts, one of which may be used to join two segments of a cue stick, in accordance with an embodiment of the invention.

In FIG. 8B, another depiction of the embodiment of the invention is shown. First segment 870 has a common end configuration 875. Universal insert 860 has a common complementary end configuration 865 adapted to receive the common end configuration 875. The universal insert 860 also has a complementary threaded configuration 867 in the specific form of a ball screw threaded pin. The complementary threaded configuration 867 allows the universal insert 860 to detachably receive the second segment 850 having a threaded configuration 855 in the form of an insert designed to receive a ball screw threaded pin. An alternate universal insert 880 has the same common complementary end configuration 865 but a different complementary threaded configuration 885.

The common end configuration and common complementary end configuration may take any form that allows the universal insert to receive, and preferably bond, with a first segment of a cue stick. Thus, the common end configuration may or may not incorporate threads, and may be externally threaded or internally threaded. The threaded configuration and complementary threaded configuration may take any form that allows the universal insert to detachably receive the second segment. Thus, the threading may be of any thread configuration (e.g., internal threading, external threading, ball screw threads, etc.).

When the common end configuration of the universal insert fits with the common complementary end configuration of the first segment without permanent bonding, universal inserts with varying complementary threaded configurations may be exchanged in the first segment. Such an arrangement allows the first segment to be changeably adapted to mate with second segments having differing threaded configurations. For example, as shown in FIG. 8A, either of the universal inserts 830, 840 may be used with the first segment 810 to allow varying complementary threaded configurations 837, 845 to mate second segments having different threaded configurations. Universal inserts having a universal adapter may also practice this feature.

The universal insert previously described may be utilized in a kit to join segments of cue sticks, or to form an adapted segment of a cue stick. The universal insert may include a universal adapter 887 having the common complementary end configuration 865, and an insert 888, in the form of a ball screw threaded pin inserted into the universal adapter 887, having the complementary threaded configuration as exemplified by the universal insert of 880 of FIG. 8B. The universal insert may also be used in a method to supply a set of segments of cue sticks to fit another set of segments of cue sticks. The segments of cue sticks joined by the universal insert may also include a segment of a cue stick incorporating a damping material.

In a preferred embodiment of the invention, the universal shaft fitting is configured such that its line of symmetry in the axial direction is aligned collinear with the line of symmetry in the axial direction of the shaft, when the universal shaft fitting is received by the shaft. As well, the line of symmetry in the axial direction of the segment which detachably receives the universal shaft fitting is also collinear. When the universal shaft fitting is comprised of a universal adapter and an insert, each of their respective lines of symmetry in the axial direction are also collinear with the lines of symmetry in the axial direction of the shaft and segment when the pieces are assembled. The more precise the matching of the lines of symmetry, the more improved the qualities of the cue stick in maintaining good playing qualities. The features of aligning the lines of symmetry may also be applied to embodiments of the invention utilizing a universal insert.

While this invention has been particularly shown and described with references to preferred embodiments thereof, it will be understood by those skilled in the art that various changes in form and details may be made therein without departing from the scope of the invention encompassed by the appended claims.

What is claimed is:

1. A universal fitting kit for adapting a set of first segments of cue sticks to receive a set of second segments of cue sticks, the set of second segments having various threaded configurations, the kit comprising:

a set of universal fittings having varying complementary threaded configurations to detachably receive the various threaded configurations of the second segments, each universal fitting having a common complementary end configuration adapted to be bonded to a common end configuration of any member of the set of first segments;

the set of first segments is a set of shafts;

the set of second segments have various pin configurations; and the set of universal fittings includes a set of universal shaft fittings having internally threaded sections of various thread configurations to detachably receive the various pin configurations of the second segments, each universal shaft fitting having a common shaft end externally threaded configuration adapted to be bonded to a butt end of any member of the set of shafts.

2. A kit according to claim 1, wherein a member of the set of universal shaft fittings comprises:

a universal adapter having the common shaft end externally threaded configuration adapted to be bonded to the butt end of any member of the set of shafts; and an insert adapted to be bonded to the universal adapter, the insert having an internally threaded region to receive a particular pin configuration of at least one member of the set of second segments.

3. A kit according to claim 2, wherein the universal adapter includes polyethylene terephthalate.

4. A kit according to claim 2, wherein the insert includes brass.

5. A kit according to claim 1 further comprising:

a set of receivers, each receiver adapted to be bonded to the butt end of any member of the set of shafts, each receiver having a common internally threaded configuration to mate and bond with the common shaft end externally threaded configuration of a universal shaft fitting.

6. A kit according to claim 1, wherein a member of the set of universal shaft fittings includes a substantially circular cross section surface with a diameter between about 0.82 inches and about 0.86 inches.

7. A kit according to claim 6, wherein the diameter is one of about 0.835 inches, about 0.841 inches, about 0.845 inches, and about 0.850inches.

8. A kit according to claim 1, wherein an internally threaded section of a member of the set of universal shaft fittings is configured with ball screw threads.

9. A kit according to claim 1, wherein an internally threaded section of a member of the set of universal shaft fittings is configured with one of ⅜-10 threads, 5⁄16-14 threads, and 5⁄16-18 threads.

10. A kit according to claim 1, wherein an internally threaded section of a member of the set of universal shaft fittings is configured to firmly and detachably mate a pin of a member of the set of second segments within about one revolution.

11. A kit with component parts capable of being assembled to create a set of adapted first segments of cue sticks to receive a set of second segments of cue sticks, the set of second segments having various threaded configurations, the kit comprising:

a set of first segments having a common end configuration; and a set of universal fittings having various complementary threaded configurations to detachably mate the various threaded configurations of the second segments, each universal fitting having a common complementary end configuration adapted to be bonded to the common end configuration of any member of the set of first segments.

12. A kit according to claim 11, wherein the set of second segments have various pin configurations;

the set of first segments includes a set of shafts having a common butt end; and the set of universal fittings includes a set of universal shaft fittings having internally threaded sections of various thread configurations to detachably receive the various pin configurations of the segments, each universal shaft fitting having a common shaft end externally threaded configuration adapted to be bonded to the common butt end of any member of the set of shafts.

13. A kit according to claim 12, wherein each universal shaft fitting comprises:

a universal adapter having the common shaft end externally threaded configuration adapted to be bonded to the common butt end of any member of the set of shafts; and an insert adapted to be bonded to the universal adapter, the insert having an internally threaded region to receive a particular pin configuration of at least one member of the set of second segments.

14. A kit according to claim 12 further comprising:

a set of receivers, each receiver adapted to be bonded to the common butt end of any member of the set of shafts, each receiver having a common internally threaded configuration to mate and bond with the common shaft end externally threaded configuration of a universal shaft fitting.

* * * * *